US009187848B2

(12) United States Patent
Graveson

(10) Patent No.: US 9,187,848 B2
(45) Date of Patent: Nov. 17, 2015

(54) METHOD FOR SPINNING ANIONICALLY MODIFIED CELLULOSE AND FIBRES MADE USING THE METHOD

(75) Inventor: Ian Graveson, Nuneaton (GB)

(73) Assignee: SAPPI Netherlands Services B.V., Maastricht (NL)

( * ) Notice: Subject to any disclaimer, the term of this patent is extended or adjusted under 35 U.S.C. 154(b) by 24 days.

(21) Appl. No.: 14/003,831

(22) PCT Filed: Mar. 8, 2012

(86) PCT No.: PCT/EP2012/053989

§ 371 (c)(1),
(2), (4) Date: Oct. 28, 2013

(87) PCT Pub. No.: WO2012/120074

PCT Pub. Date: Sep. 13, 2012

(65) Prior Publication Data

US 2014/0053995 A1 Feb. 27, 2014

(30) Foreign Application Priority Data

Mar. 8, 2011 (EP) ..... 11157314

(51) Int. Cl.

| | |
|---|---|
| ***D01F 1/00*** | (2006.01) |
| ***D01F 2/24*** | (2006.01) |
| ***D01D 1/02*** | (2006.01) |
| ***D01D 5/40*** | (2006.01) |
| ***D01F 6/00*** | (2006.01) |
| ***D01F 2/00*** | (2006.01) |
| ***D21H 13/02*** | (2006.01) |
| *D21H 15/00* | (2006.01) |

(52) U.S. Cl.

CPC .. *D01F 6/00* (2013.01); *D01D 1/02* (2013.01); *D01D 5/40* (2013.01); *D01F 1/00* (2013.01); *D01F 2/00* (2013.01); *D01F 2/24* (2013.01); *D21H 13/02* (2013.01); *D21H 15/00* (2013.01)

(58) Field of Classification Search

USPC ..... 162/157.1, 157.6, 157.7; 264/176.7; 254/207; 977/700, 788, 795; 536/56–59, 62, 63

See application file for complete search history.

(56) References Cited

U.S. PATENT DOCUMENTS

| | | | | |
|---|---|---|---|---|
| 2,974,005 | A | 3/1961 | Heuer et al. | |
| 3,357,845 | A | 12/1967 | Battista | |
| 2004/0118540 | A1* | 6/2004 | Garnier et al. | 162/164.1 |
| 2011/0263840 | A1* | 10/2011 | Turner et al. | 536/56 |

FOREIGN PATENT DOCUMENTS

| | | | |
|---|---|---|---|
| GB | 580 050 | A | 8/1946 |
| WO | 2010/043889 | A1 | 4/2010 |

OTHER PUBLICATIONS

International Search Report for PCT/EP2012/053989 dated May 23, 2012.

* cited by examiner

*Primary Examiner* — Dennis Cordray
(74) *Attorney, Agent, or Firm* — Sughrue Mion, PLLC

(57) ABSTRACT

The present invention is directed towards a method for spinning anionically modified cellulose comprising the steps of: (a) preparing a suspension of the anionically modified cellulose in a continuous phase; (b) subjecting the suspension to high shear rate; (c) performing spinning by extruding the cellulose suspension through a spinneret into a spinbath comprising a cationic complexing agent, and (d) isolating the sun fibers from the spin bath; as well as fibers obtained based on the method of the invention and paper or board products derived from such fibers.

16 Claims, No Drawings

METHOD FOR SPINNING ANIONICALLY MODIFIED CELLULOSE AND FIBRES MADE USING THE METHOD

CROSS REFERENCE TO RELATED APPLICATIONS

This application is a National Stage of International Application No. PCT/EP2012/053989 filed Mar. 8, 2012, claiming priority based on European Patent Application No. 11 157 314.3 filed Mar. 8, 2011, the contents of all of which are incorporated herein by reference in their entirety.

FIELD OF THE INVENTION

The present invention is directed towards a method for spinning anionically modified cellulose, fibres obtained based on the method of the invention and paper or board products derived from such fibres.

BACKGROUND OF THE INVENTION

Cellulose in particular in the form of fibres can be used for many applications and products, so e.g. for the making of paper or board structures, but also for making spun fibres such as viscose fibres or lyocell fibres which show excellent mechanical properties. Due to the chemical nature of cellulose in principle acceptable properties as concerns e.g. tensile strength can be reached, however the starting material for the spinning process, the so called spinning suspension, as well as the extrusion and subsequent solidification e.g. in a spin bath can often release hazardous and noxious materials, for example carbon disulphide and hydrogen sulphide which need to be recovered. In addition these commercial systems are currently unable to achieve very high tensiles, for example greater than 85 cN/tex.

SUMMARY OF THE INVENTION

The present invention is directed towards an improved method for spinning anionically modified cellulose, fibres obtained based on these methods and paper or board products derived from such fibres.

More specifically, the invention provides a method for spinning anionically modified cellulose comprising the steps of: (a) preparing a suspension of the anionically modified cellulose in a continuous phase; (b) subjecting the suspension to high shear rate; (c) performing spinning by extruding the cellulose suspension through a spinneret into a spinbath comprising a cationic complexing agent, and (d) isolating the spun fibres from the spinbath.

In preferred embodiments the anionically modified cellulose is a cellulose nanofibril derivatized with sulphur containing groups, such as sulfated or sulfonated cellulose nanofibrils.

The anionically modified cellulose is preferably used in the form of nanofibrils. These are characterized by an average length in the range of 15-300 nm, preferably in the range of 50-200 nm. The average thickness is preferably in the range of 3-3000 nm, preferably in the range of 10-100 nm.

As used herein, the term "nanofibril" or "nanofibrillar" in combination with cellulose refer to cellulose that is substantially completely in the form of nanofibrils, and those which may be substantially nanofibrillated while containing minor but not significant amounts of non-nanofibrillar structure, provided that the cellulose is in sufficient nanobrillar form to confer the benefits necessary for use in the methods of the present invention.

The cellulose nanofibrils may be extracted from nanofibril containing cellulose-based material, including hydrolyzed or mechanically disintegrated cellulose obtained from cotton linter, hard or soft wood pulp, purified wood pulp or the like, commercially available cellulose excipients, powdered cellulose, regenerated cellulose, microcrystalline and low crystallinity celluloses. Preferred cellulose sources are derived primarily from wood pulp. Suitable wood pulp fibres include ground wood fibres, recycled or secondary wood pulp fibres, and bleached and unbleached wood pulp fibres. Both softwoods and hardwoods can be used. Details of the selection of wood pulp fibres are well known to those skilled in the art. Suitable wood pulp fibres for use in the present invention can be obtained from well known chemical processes such as the kraft and sulfite processes, with or without subsequent bleaching. Pulp fibres can also be processed by thermomechanical, chemi-thermomechanical methods, or combinations thereof. Preferably the cellulose is obtained by chemical pulping and extraction. The anionic charge is preferably provided by derivatisation with suitable groups carrying a negative charge, such as sulphur-containing groups (e.g. sulfate, sulfonate, alkylsulfate, alkylsulfonate), carboxyl groups, phosphor-containing groups (e.g. phosphate, phosphonate), nitro groups or the like, or combinations thereof.

In a further preferred specific embodiment, the anionically modified cellulose is sulfur-derivatized cellulose, more specifically sulfur-derivatized cellulose nanofibrils. Thus, as used herein "sulfur-derivatized cellulose nanofibril" refers to a cellulose nanofibril that has been derivatized with anionically charged sulfur groups by reaction of a cellulose nanofibril with a suitable sulphating agent. It will be appreciated that sulfur-derivatized cellulose nanofibril includes free acid and salt forms where appropriate. A sulfur-derivatized cellulose nanofibril can be produced by reacting a sulfating agent with a hydroxyl group of the cellulose nanofibril to provide a cellulose sulphate ester according to literature procedures (see e.g. Cellulose (1998) 5, 19-32 by Dong, Revol and Gray).

Optional additional process steps include e.g. purification and concentration of the fibres obtained according to the methods of the invention. Thus in one embodiment, the methods of the invention further comprise a purification step such as diafiltration (for example using the equipment provided by Memcon of South Africa using ceramic membranes supplied by Atech Innovations of Germany) which refers to any technique in which the solvent and small solute molecules present in a suspension of the fibres are removed by ultrafiltration and replaced with different solvent and solute molecules. Diafiltration may be used to alter the pH, ionic strength, salt composition, buffer composition, or other properties of a suspension of the fibres. Unless otherwise specified, the term diafiltration encompasses both continuous and batch techniques. In another embodiment, the methods of the invention further comprise a concentration step wherein the percentage solids in the solvent are increased. The concentration steps may be performed using, for example, a twin screw extruder fitted with one or more vacuum extraction stages, a LIST compounder fitted with vacuum extraction, a BUSS filmtruder etc.

The degree of substitution of anionically modified groups on the cellulose nanofibril should be sufficiently low such that the derivatized cellulose nanofibril will be substantially insoluble in the continuous phase that is present in the intended methods of the invention.

In specific embodiments, the anionically modified cellulose nanofibre of the invention can be characterized as having an average degree of substitution by an anionic group of from about 0.01 to about 2. In one embodiment the modified cellulose nanofibre has an average degree of substitution by an anionic group of less than 1.0, preferably less than 0.5.

As used herein the "average degree of substitution by an anionic group" refers to the average number of moles of the respective anionic group per mole of glucose unit in the modified nanofibril. Thus, the average degree of e.g. sulfate group substitution refers to the average number of moles of sulfate groups per mole of glucose unit in the modified nanofibril.

Preferably the suspension of the anionically modified cellulose is prepared in a continuous phase in which the anionically modified cellulose is substantially insoluble. The term "substantially insoluble" refers to such a small degree of solubility so as not to effect the nanofibrillar structure of the cellulose. It is understood that the solubility of the anionically modified cellulose depends on the degree of substitution with the anionically charged groups. The term "continuous phase" refers to a liquid in which the anionically charged cellulose is dispersed, with or without the presence of additives. Examples of a suitable continuous phase includes aqueous solvents, alcohols, ethers, ketones, preferably aqueous solvents, more preferably water. The term "aqueous solvent" refers to a solvent comprising at least 50%, preferably at least 80%, more preferably at least 90% and optimally from 95 to 100% water by weight of the solvent. The aqueous solvent may have a pH of from 2 to 10, more preferably from 4 to 8 and optimally from 5.5 to 7.5 at 20° C.

Preferably, in the spinning suspension the anionically modified cellulose is provided in a concentration range of between about 0.01% and about 100%, preferably between about 1.0% and 80%, more preferably between about 5.0% up to about 60%.

If desired, cationic additives may be added to the suspension of anionically modified cellulose nanofibrils to provide latent crosslinking capability during the extrusion and draw stages in the wet spinning bath The term "high shear", as used herein, means a shear rate of more than about 1000 sec-1, preferably more than 10,000 sec-1 and more preferably more than 20,000 sec-1. In one embodiment, this stage is positioned immediately before the spinning stage. In a further embodiment, it is placed close to the spinneret and after all concentration and purification stages. The necessary high shear conditions are obtained using e.g. a series of one or more sintered metal plates with pores sizes of 1 to 50 μm, preferably 5 to 25 μm. If preferred a mixture of pore size plates can be used in stacked arrangement. Alternatively a mechanical throttle device can be used such as a zero die having an orifice of 10 to 1000 μm diameter, more preferably 20 to 200 μm.

The term "cationic complexing agent" as used herein refers to a molecular substance that carries at least two positive charges when it is in solution in a protic solvent, preferably in aqueous solution, and in a given pH-range. Preferably, the cationic complexing agent includes monovalent or polyvalent organic cationic species, including metal cations.

The term "polyvalent cation" refers to a cation having a charge of at least equal to 2.

Examples of polyvalent metal cations include preferably divalent metal cations such as zinc, magnesium, manganese, aluminium, calcium, copper and the like.

Preferably, the cationic complexing agent is an inorganic cationic species having a charge of preferably 2 to 4, such as zinc, aluminium, calcium and magnesium, more preferably zinc and aluminium.

Preferably, the cationic complexing agent comprises a metal cation or inorganic cationic species at a concentration from 0.1 ppm to 10,000 ppm, more preferably from 10 to 5000 ppm. This range applies to the concentration that can be added to the suspension of anionically modified cellulose nanofibrils prior to extrusion and also to the concentration in the spinbath equally the cationic additive can be included in both locations.

The spinning is performed by extruding the cellulose suspension through a spinneret into a spinbath. The spinneret is preferably a submerged spinneret (wet jet wet spinning) or a spinneret suspended above the spinbath surface (dry jet wet spinning) with hole sizes in the range 40 to 250 μm, preferably 60 to 120 μm. Typically, spinnerets may have between 1 and 50,000 holes. The anionically modified cellulose suspension is extruded into spinbath comprising a cationic complexing agent.

Preferably the spinbath is an aqueous bath optionally further comprising one or more of an osmotic pressure modifier and/or an alkaline reagent. The osmotic pressure modifier may be sodium sulfate or the like and is preferably up to 340 g/l, preferably in the range from 100 to 400 g/l.

The alkaline reagent may be at least one of sodium hydroxide, an oxide or hydroxide of an alkali metal or alkaline earth metal, an alkali silicate, an alkali carbonate, an amine, ammonium hydroxide, tetramethyl ammonium hydroxide, or combinations thereof.

The pH of the spin bath may be preferably adjusted to range of from pH 5 to pH 13, preferably pH 7 to 12.

The temperature of the spinbath is preferably between 15 and 80° C., more preferably 20 and 60° C. Residence time of the extruded anionically charged cellulose suspension in the spinbath is preferably between 0.1 and 30 seconds, preferably 1 and 5 seconds. Sufficient tension is maintained in the spinbath to prevent substantial excessive sagging of the filaments in the spinbath.

The fibres formed in the spinbath pass, via a roller arrangement designed to prevent slippage, into a stretch bath comprising water and an alkaline reagent as defined hereinabove. The pH of the stretch bath is preferably in the range pH 3 to pH 13, preferably pH 7-10. Said stretch bath is maintained at 40 to 100° C., preferably 75 to 98° C. Stretch is applied to align the fibre and reduce the measure decitex (also dtex, which is the mass in grams per 10,000 meters). A stretch of 10 to 1000% is possible but preferably 30 to 500% is used.

The fibres exit the stretch bath via a roller arrangement designed to prevent transmission of tension between baths into a wash bath comprising water at 90 to 100° C. An alkaline reagent as defined above can be added to complete the washing process to maintain a pH of preferably 7 to 9.

The obtained fibre is then dried in the usual manner as known in the art (such as using a hot drum dryer, conveyer belt dryer, infrared heaters and the like). Tension may be applied during this process. Tensions during the washing and drying steps of this invention are typically maintained at 0.05 to 0.35, preferably at 0.05 to 0.25 grams per denier.

DETAILED DESCRIPTION OF THE INVENTION

The invention shall now be illustrated and supported by specific examples, however these examples shall no be used or construed to limit the scope of the invention as detailed above and as defined in the appended claims.

Example 1

A suspension of cellulose nanofibrils, derivatised to carry a negative charge, is extruded through a stack of porous sintered metal plates comprising a 25 μm plate, then a 10 μm plate followed by a third of 25 μm closest to the spinneret. The suspension of cellulose nanofibrils is then extruded through a spinneret with an 80 μm exit diameter into a spinbath comprising 280 g/1 sodium sulphate and 1000 ppm zinc sulphate. The fibre formed remains in contact with the spinbath solutions for 2 seconds and is then moved via a clover leaf roller arrangement into a second bath containing water at 98° C. where stretch is applied. A total of 200% stretch is applied. The fibre then moves via a second clover leaf arrangement into a third bath containing water at 98° C. for final washing and is then removed from the bath and dried at elevated temperature as known from the prior art (such as using a hot drum dryer, conveyer belt dryer, infrared heaters and the like).

Example 2

A suspension of cellulose nanofibrils, derivatised to carry a negative charge, is extruded through a zero die with an orifice diameter of 100 μm and then directly into a spinneret with an 80 μm exit diameter into a spinbath comprising 1500 ppm zinc sulphate. The fibre formed remains in contact with the spinbath solutions for 3 seconds and is then moved via a clover leaf roller arrangement into a second bath containing water and an alkali at 98° C. and pH 8.5 where stretch is applied. A total of 100% stretch is applied. The fibre then moves via a second clover leaf arrangement into a third bath containing water at 98° C. for final washing and is then removed from the bath and dried in the normal manner at elevated temperature (as indicated hereinabove).

Example 3

A suspension of cellulose nanofibrils is created following the method set out in Cellulose (1998) 5, 19-32. This is purified and partially concentrated using a diafiltration unit from Memcon and ceramic membrane from Atech Innovation. The suspension is then concentrated to a solids content of 30% w/w cellulose in an aqueous solvent. During the concentration processes 100 ppm of zinc sulphate (on cellulose) is added with mixing. The resulting concentrated suspension of cellulose nanofibrils is extruded via a high shear device connected directly to a spinneret with a 100 μm exit diameter. The remainder of the spinning process is as defined in example 1 (above). The resultant fibre has a dry tenacity of at least 85 cN/tex.

Example 4

A suspension of cellulose nanofibrils is created following the method set out in Cellulose (1998) 5, 19-32. This is purified and partially concentrated using a diafiltration unit from Memcon and ceramic membrane from Atech Innovation. The suspension is then concentrated to a solids content of 30% w/w cellulose in an aqueous solvent but pH is only partially corrected resulting in a spinning gel at pH 3. This gel is extruded through a spinneret with an 80 μm exit diameter into a spinbath comprising dilute sodium hydroxide and 100 ppm zinc sulphate. The fibre formed remains in contact with the spinbath solutions for 2 seconds and is then moved via a clover leaf roller arrangement into a second bath containing dilute acid at 98° C. where stretch is applied. A total of 200% stretch is applied. The fibre then moves via a second clover leaf arrangement into a third bath containing water at 98° C. for final washing and is then removed from the bath and dried at elevated temperature in the normal manner (as indicated hereinabove).

The invention claimed is:

1. A method for spinning fibres from anionically modified cellulose to produce spun fibres, comprising the steps of:

(a) preparing a suspension of the anionically modified cellulose in a continuous phase;

(b) subjecting the suspension to high shear rate;

(c) performing spinning by extruding the cellulose suspension through a spinneret into a spin bath comprising a cationic complexing agent, and (d) isolating the spun fibres from the spin bath.

2. The method according to claim 1, wherein the anionically modified cellulose is a substantially nanofibrillar cellulose.

3. The method according to claim 2, wherein said cellulose is obtained from nanofibril containing cellulose-based material, including hydrolyzed or mechanically disintegrated cellulose obtained from cotton linter, hard or soft wood pulp, purified wood pulp, commercially available cellulose excipients, powdered cellulose, regenerated cellulose, microcrystalline and low crystallinity celluloses.

4. The method according to claim 1, wherein the continuous phase is an aqueous solvent.

5. The method according to claim 1, wherein the anionically modified cellulose is substituted with groups carrying a negative charge, chosen from sulphur-containing groups, carboxyl groups, phosphor-containing groups, nitro groups, or combinations thereof.

6. The method according to claim 5, wherein the anionically modified cellulose has a degree of substitution of less than 0.5.

7. The method according to claim 1, wherein the cationic complexing agent is selected from divalent metal cations.

8. The method according to claim 7, wherein the concentration of the cationic complexing agent in the spin bath is in the range of 0.1 to 10000 ppm.

9. The method according to claim 1, wherein the spin bath is at a temperature in the range of 15 to 80° C.

10. The method according to claim 1, wherein the cellulose suspension is at a temperature in the range of 10 to 95° C.

11. The method according to claim 1, wherein the continuous phase is an aqueous solvent with a water content of at least 95 weight %.

12. The method according to claim 1, wherein the continuous phase is an aqueous solvent with a water content of at least 98 weight %.

13. The method according to claim 1, wherein the cationic complexing agent is zinc or aluminium.

14. The method according to claim 1, wherein the cellulose suspension is at a temperature in the range of 20 to 50° C.

15. The method according to claim 1, wherein the anionically modified cellulose is substituted with groups chosen from sulfate, sulfonate, alkylsulfate, alkylsulfonate, phosphate, or phosphonate.

16. The method according to claim 1, wherein the cationic complexing agent is selected from the group consisting of zinc, magnesium, manganese, aluminium, calcium, or copper.

* * * * *